United States Patent [19]

Vogt

[11] Patent Number: 4,951,492

[45] Date of Patent: Aug. 28, 1990

[54] HYDRAULIC EXPANSION OF TUBING

[75] Inventor: Gerd Vogt, Meerbusch, Fed. Rep. of Germany

[73] Assignee: Mannesmann AG, Düsseldorf, Fed. Rep. of Germany

[21] Appl. No.: 367,187

[22] Filed: Jun. 15, 1989

[30] Foreign Application Priority Data

Jun. 16, 1988 [DE] Fed. Rep. of Germany ..... 3820952

[51] Int. Cl.[5] ..... B21D 26/02

[52] U.S. Cl. ..... 72/61; 59/62

[58] Field of Search ..... 72/56, 58, 59, 61, 62, 72/60; 29/421.1

[56] References Cited

U.S. PATENT DOCUMENTS

| | | | |
|---|---|---|---|
| 3,625,040 | 8/1969 | De Gain | 72/62 |
| 4,751,836 | 6/1988 | Breese | 72/61 |
| 4,827,748 | 5/1989 | Herring | 72/58 |

FOREIGN PATENT DOCUMENTS

| | | | |
|---|---|---|---|
| 0532335 | 10/1956 | Canada | 72/59 |
| 0350946 | 2/1961 | Switzerland | 72/59 |

*Primary Examiner*—David Jones

*Attorney, Agent, or Firm*—R. H. Siegemund

[57] ABSTRACT

Hollows are hydraulically widened as their ends are closed by sealing heads which include inflatable sealing rings bearing against the hollow at a pressure that is always in excess of the widening pressure applied to the hollow.

5 Claims, 2 Drawing Sheets

Fig. 2
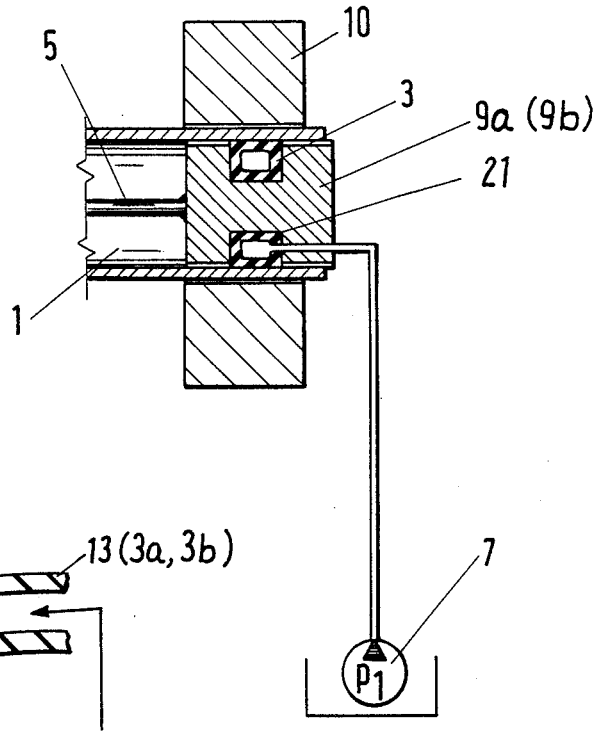
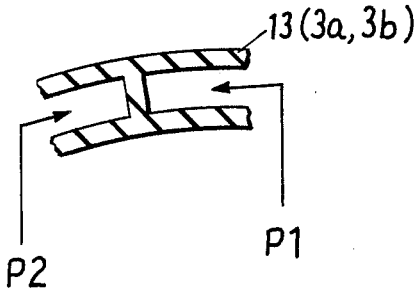
Fig 3

HYDRAULIC EXPANSION OF TUBING

BACKGROUND OF THE INVENTION

The present invention relates to the widening of hollows made of metal, particularly steel tubes, under utilization of a multielement outer tooling and sealing the front faces of the hollow so that on the inside a strong hydraulic pressure can be produced to obtain the widening whereever and to whatever extend needed. Moreover, the invention relates to equipment for providing this widening under utilization of particularly configured sealing heads interconnected through tie-rods.

Hollow or hollow sections of the kind to which the invention pertains and which are processed in accordance with the invention are basically tubular elements made of metal particularly steel which may have any kind of cross section, in other words emphasis is on elongated configuration basically cylindrical or curved ones but with any kind of cross section.

Frequently in technology, civil engineering or the like, parts are needed which are basically of an elongated configuration, either straight but also curved ones are of interest and having a cross section that may vary drastically along the length extension. For reasons of weight such construction parts are often made as hollows or tubes simply because the strength requirements do not require solid configuration. Here then it was suggested, particularly for limiting expenditure in the making process to provide basically a tubular blank and to change the configuration of the blank through local control widening.

German patent No. 29 35 086 discloses a method and equipment wherein a tube is subjected to an internal hydraulic pressure forcing the tube's wall locally against an outer rigid tube. The deformation is supported in addition by axial pressure acting on the tube being deformed and in addition to the hydraulic internal pressure. In the beginning of the deformation, the hollow is completely enveloped in the so called guiding tube except for the central part. These guiding tubes are gradually retracted in axial direction during the deforming so that progressively increased actual region of deformation is made of available for that purpose, not at once but in a graduated fashion.

The open front faces of the hollow being deformed are sealed through piston-like elements having appropriate sealings. The pistons are inserted in the hollow and provide, in addition, supplemental axial pressure. Further sealing is established through the guiding tubes which in turn envelops the piston rods. The sealing effect is not changed in principle as the guiding tubing is gradually retracted for the aforestated purpose. This known method and equipment as outlined above rather rudimentarily is actually very expensive and complex. Moreover it is not suited for processing blanks towards obtaining a curved or even angled off component. On the other hand it has to be considered that the disposition of sealing for obtaining the hydraulic expansion requires a very accurate treatment of the sealing surfaces and a very accurate tuning of the piston geometry in relation to the hollow blank. Tolerances whatever and whereever they are, may readily lead to problems of an unforeseeable nature in the working stage as far as resulting in unforeseeable deformations are concerned.

DESCRIPTION OF THE INVENTION

It is an object of the present invention to provide a new and improved method for hydraulically expanding metallic hollows and tube sections in a rather simple fashion and wherein particularly the sealing of the hollow blank during the working can be carried out in a rather simple fashion.

It is a specific object of the present invention to provide a method of deforming hollows which are open at front ends and are made of metal, particularly steel, under (i) utilization of an enveloping multipart outer tool; (ii) double sealing at the ends of the hollow; and (iii) utilizing gradually applied hydraulic internal pressure.

It is another object of the present invention to provide a new and improved equipment for widening hollow sections under utilization of two sealing heads interconnected by means of tie rod-like elements, further under utilization of pressurization means for filling and pressurizing the hollow in a variable fashion as far as the pressure that is applied to the interior of the hollow being widened is assumed.

In accordance with the preferred embodiment of the present invention it is suggested to provide the sealing heads basically as rigid components closing off the insertion of the hollow being widened and to seal these heads as against the hollow and the exterior by means of elastic hollow sealing rings which sealing rings themselves receive an internal pressure that is larger than any pressure applied to the interior of the hollow being deformed, whereby the widening of the hollow in the area of the sealing ring is limited simply to the matching capabilities of the respective hollow sealing ring.

Each sealing head is thus provided with a hollow sealing ring made of elastic material. This ring is inserted in an appropriate annular chamber or groove of the respective sealing head which is open in a radially inward or outward fashion. The contour permits groove so that in fact the sealing ring can be inserted. The groove in which such a sealing ring is inserted restrains the expansion of the ring except in a direction normal to the open side of the groove and exactly that is the direction of desired sealing.

The sealing head acts sealingly in radial direction near the axial end of the hollow to be widened. In that zone, the head is just a little larger than the hollow or smaller so that either the hollow can be readily inserted in the sealing head or the latter can be inserted in the former. In either case, as the sealing ring inserted in the grooves is appropriately inflated and subjected to the high pressure, it will provide its sealing function against the hollow, from the inside or the outside.

It is thus an essential feature of the invention to close off the basically open ends of the hollow to be widened by means of rigid sealing heads which do provide for a general closing but for not sealing. The elastic sealing rings of a hollow configuration are made a part of the sealing head and are strongly inflated and provide the sealing function proper in a controlled fashion. The sealing ring in each instance is fastened and housed in the sealing head to be basically limited in its expandibility. As stated earlier, the ring is basically expendable in radial direction only towards the outside or inside of the hollow to be sealed. The contour of any groove in the sealing head receiving the sealing ring avoids that the ring can laterally escape or undergo otherwise undesired expansions. Whatever expansion the sealing ring is capable of will be effective in a sealing fashion towards the hollow to be sealed. During operation and once sealing has been effected the hollow is subjected to internal hydraulic pressure but that pressure is below the pressure of the hollow sealing ring. Hence there is no danger of leakage in the sealing nor will the hollow be widened in the area of the sealing ring. It is an added feature of the invention that the elasticity of the sealing ring takes up physical tolerances between the sealing head on one hand and the hollow on the other hand. These tolerances may be attributable to dimensional errors or to certain surface unevennesses or the like.

The sealing ring may act on the hollow from the outside and provide nondeforming support at specific locations whereever the sealing ring applies sealing pressure as far as the hollow being deformed is concerned. An alternative sealing can be had by inserting the sealing head into one end of the hollow and having the sealing ring pressurized to be urged radially outwardly into tight abutment with the hollow to be widened. In either case the rule prevails that the pressure in the hollow sealing ring is larger than the pressure of widening the hollow.

Conceivably the pressure of the sealing ring may be a constant one and be certainly higher than any hydraulic widening pressure that may be applied to the interior of the hollow. On the other hand it might be advisable to limit the pressure in the sealing ring to be just a certain percentage, such as 10 to 20%, larger than the widening pressure as it prevails in any given instance. In other words as the widening pressure increases or decreases so is the sealing pressure in the sealing ring. Or one can say that the sealing ring pressure tracks the widening or expanding pressure.

It has also been mentioned that the particular sealing ring is of uniform configuration but it may be advisable in certain complex cases to provide different chambers or sections in the sealing ring and to provide each of the chambers separately with differing sealing pressure. The purpose here is to be more flexible in the adaptation as far as irregular or noncircular or nonround cross-sectional geometry is concerned in widening the blank. The same sealing head is used for different tasks and here different sealing rings are provided for purposes of matching and adaptation. The critical point in all these instances is to make sure that the sealing function remains in fact regardless of what the variations and the variable factors are. In the case of a multiple element sealing ring care must be taken that the individual sections or segments of a sealing ring are mutually supporting; i.e. they must not work against each other.

In order to avoid that the sealing heads are not axially pushed away from the hollow against which they abut it is necessary to make sure that forces be provided to hold them in the sealing axial position. This is carried out preferably through tie rods which interconnect sealing heads or opposing ends of the hollow being deformed. From a practical point of view the tie rod structure is preferably included in the interior and traverse the hollow as a single element. Alternatively multiple tie rods may be provided along the outside of the hollow.

The term "tie rod" is to be understood in a general sense; it is flexible i.e. bendible element such as a rope, a chain, a cable or the like. This aspect is particularly important if, say originally the hollow is straight and now the deformation and widening includes a bending or curving process. In this case then there is a change in orientation of the sealing heads in relation to each other, and the bendible tie rod element was capable of taking up these changes. In other cases the holding structure for the sealing heads may be integrated in the particular outer tool that limits the hydraulic radial expansion of the hollow as it is being widened.

DESCRIPTION OF THE DRAWING

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

FIG. 2 illustrates the modification particularly as far as the sealing head is concerned, other components being similar to the one in FIG. 1; and FIG. 3 is a cross section somewhat schematically showing sectionalization of a sealing ring.

Figure 1:
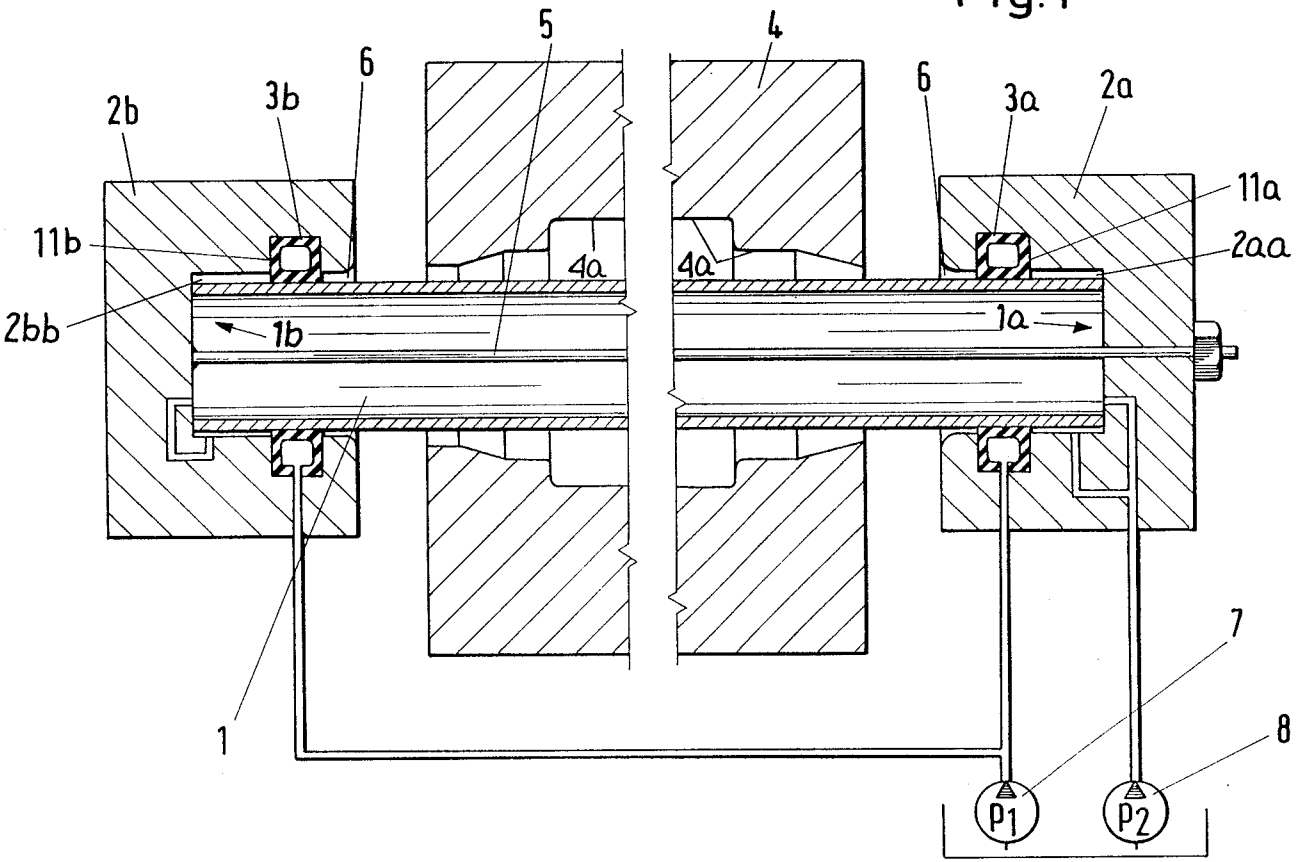
FIG. 1 illustrates somewhat schematically a longitudinal section view through equipment for practicing the preferred embodiment of the present invention under best mode considerations.

Proceeding now to the detailed description of the drawings, reference numeral 1 refers to a hollow tube. For simple reasons of explanation it is a cylindrical steel tube. The steel tube has open ends 1*a* and 1*b* and these ends are closed by means of sealing heads 2*a* and 2*b*. These sealing heads are provided with blind bores 2*aa* and 2*bb*, e.g. for receiving the ends 1*a*, 1*b* of the hollow tube 1. The respective bore in each head itself has a surface of a cylindrical configuration to receive with ease the hollow tube 1. In each of these heads an annular chamber such as 11*a* and 11*b* is provided for receiving a sealing ring, respectively 3*a* and 3*b*. The annular chambers 11*a* and 11*b* are, of course, open in radial inner direction facing the inserted hollow.

The sealing rings 3*a* and 3*b* are made of elastic material such as hard rubber or the like and are connected throught the respective head, 3*a*, 3*b* to the hydraulic source 7. That source provides hydraulic fluid into the interior of the sealing ring with a pressure such as P1. As soon as this pressure is applied to any of the sealing rings 3*a* and 3*b* the ring basically widens and roughly then quarter of its outer contour is forced in conformity with the contour of the duct channel or chamber 11. The chambers 11*a* and 11*b* respectively hold the rings 3*a* and 3*b* only from three outer sides which means that either ring can expand radially inwardly towards the hollow 1. Depending on the pressure that is applied to the interior of the sealing rings 3*a* and 3*b* they are more or less tightly and thus sealingly urged against the outer surface of the tube 1. This way then the gaps 6 between the hollow 1 and the blind bores in each instance are sealingly bridged.

The two sealing heads 2*a* and 2*b* are interconnected through a longitudinal tie rod-like element 5 which may be a rod proper or a cable, a rope or a chain. The heads are connected so that subsequently and as the tube expanding pressure P2 is applied to the interior of the hollow 1, that pressure will not be able to push the sealing heads 2*a* and 2*b* off the hollow. The blind bores of each sealing head therefore remain in abutment with the front ends of the hollow 1.

The deformation of the hollow 1 is provided in cooperation with outer tooling 4 being of a multipart configuration and in a manner known per se. Tool 4 envelopes the hollow 1 for most of its part and may have a rather complex internal contour 4*a* which will be the contour of the object to be made by means of deformation involving the application of deformation pressure P2 from a source 8 and applied to the interior of the tube 1.

The entire arrangement functions as follows. Initially rings 3*a* and 3*b* are provided to receive internal pressure P1 after the tube 1 has been stuck into the heads 2*a* and 2*b* and now a sealing engagement of the heads is established vis-a-vis hollow through the sealing rings 3*a* and 3*b*. Next, pressure P2 is applied to the interior of the hollow 1 in order to obtain widening. It is assumed that initially that pressure P1 is fairly low and it is tied or slaved to the pressure P2, to remain always a fixed percentage above the pressure P2 so that the pressure differential remains more or less constant making sure that regardless of the specific pressure values involve, P1 is always sufficiently above any internal widening pressure P2 as far as the tube 1 is concerned. This way it is made sure that sealing has never been interfered with.

As soon as pressure P2 is increased the tension in the walls of the hollow section 1 exceeds the flow limit, and the hollow 1 will be forced against the inner contour of 4*a* of the tool 4. The two sealing heads 2*a* and 2*b* are held in relative position throughout the operation by means of the tie element 5.

FIG. 2 illustrates a replacement of the sealing heads 2*a* and 2*b* as shown in FIG. 2 by an internal sealing head. Here then the head 9*a*,9*b* is inserted in the hollow 1 from opposite ends and its chamber 21 is open in radial outward direction. The ring chamber 21 receives a sealing ring 13. As pressure is applied to the interior of ring 13, the ring will expand in radially outward direction and abut against the inner wall of the tube 1 to be widened thereby effecting the sealing function of the head to which the ring 13 pertains.

It should be noted that for this case an outer support 10 is needed since it must be prevented that the sealing ring 13, through its radial outward pressure, widens the tube 1 over and beyond what is needed and desired as far as its widening and expansion generally is concerned. Hence, the tube 1 has its end stuck on each end to a holder 10 which prevents radial expansion beyond the tolerances, and now the sealing is provided by the ring 13 and will not be affected as a widening.

Care must be taken in the foregoing not to have the sealing ring 13 cause metal of holder 10 to expand beyond the elastic limit as that might cause the tube to be stuck in the support 10. If this problem cannot be avoided in this fashion then the part 10 must be made of a multipart construction that is assembled and disassembled laterally.

Independent from the kind of sealing heads used it is usually necessary to cut off the end of the hollow 1 i.e. the hollow or tube 1 is made initially in excess as far as axial dimensions are concerned, exactly to permit that cut-off if, whatever the situation is, the contour of the ends does not correspond to the desired contour of the finished product. That is most likely the case. It can thus readily be seen that inventive method and equipment is rather simple and permits ready adaptation to curved configurations even if the initial material with the straight tube.

The invention is not limited to the embodiments described above but all changes and modifications thereof, not constituting departures from the spirit and scope of the invention, are intended to be included.

I claim:

1. Device for expanding and forming a desired shape in a central portion of a hollow tubular blank by a hydraulic pressure means, said device further including two sealing heads for closing off open end portions of said hollow blank, the improvement comprising:

an outer tooling surrounding said central portion of said hollow blank and having an internal contour of the said desired shape, said outer tool being separated from the two sealing heads;

said two sealing heads being interconnected and engaging the open end portions of the hollow blank with play, the sealing heads each further including annular groove means and including respectively a hollow sealing ring in each such groove means for sealing off, under pressure, said open end portions of the hollow blank; and means for providing fluid pressure to respective hollow interiors of said sealing rings, said fluid pressure means supplying pressure greater than the hydraulic pressure applied to the interior of the hollow blank being expanded.

2. Device as in claim 1, said sealing heads being flexibly interconnected within and through the hollow blank being expanded.

3. The improvement as in claim 1, the interior of the rings being sectionalized, there being separate pressures applied to individual sections of the rings.

4. The improvement as in claim 1, said sealing heads each having a cylindrical portion for insertion into the open end portions of the tubular hollow blank to be expanded, the groove being on an outer periphery of the cylindrical portion, the sealing ring being forced radially outwardly against the hollow blank.

5. The improvement as claim 1, said sealing head each being of a blind bore configuration, the open end portion of the tubular hollow blank being repsectively inserted into the blind bore, the bore being provided with said groove being open in a radially inward direction and receiving said sealing ring such that the sealing ring is urged radially inwardly against the tubular hollow blank being expanded.

* * * * *